US006591643B1

(12) United States Patent
Cannella et al.

(10) Patent No.: US 6,591,643 B1
(45) Date of Patent: Jul. 15, 2003

(54) KEYLESS LOCKING SYSTEM

(76) Inventors: Thomas Cannella, 1416 View Top Dr., Clearwater, FL (US) 33764; Robert Cannella, 8023 Cardinal Dr., Tampa, FL (US) 33617

( * ) Notice: Subject to any disclaimer, the term of this patent is extended or adjusted under 35 U.S.C. 154(b) by 0 days.

(21) Appl. No.: 10/016,365

(22) Filed: Dec. 10, 2001

(51) Int. Cl.[7] ..... E05B 47/02

(52) U.S. Cl. ..... 70/277; 70/257; 70/280; 292/142; 292/144

(58) Field of Search ..... 70/257, 280, 281, 70/282; 292/144

(56) References Cited

U.S. PATENT DOCUMENTS 5,678,436 A * 10/1997 Alexander ..... 70/278.3
6,012,310 A * 1/2000 Hsiao ..... 70/278.2
6,062,612 A * 5/2000 Lin ..... 292/144
6,076,383 A * 6/2000 Clark et al. ..... 70/189
6,216,502 B1 * 4/2001 Cannella et al. ..... 70/277
6,244,084 B1 * 6/2001 Warmack ..... 70/278.1
6,471,257 B1 * 10/2002 Lu et al. ..... 292/144
2001/0027669 A1 * 10/2001 Warmack ..... 70/257

* cited by examiner

*Primary Examiner*—Anthony Knight
*Assistant Examiner*—Christopher Boswell

(57) ABSTRACT

A keyless locking system comprises a housing with a planar plate constituting a front wall and peripheral walls extending inwardly to form an open housing. A rotatable assembly is rotatably secured within the housing. The rotatable assembly includes a rotator with a cylindrical shaft, a spring loaded retention member, a channel member and a trapezoidal end plate. The channel member has a parallel plate with a pair of sidewalls to encompass and contact the sides of a deadbolt. The first end has a retention bar between the sidewalls. A gearing assembly and an associated motor are provided. An electronic assembly is provided to effect the driving of the motor and worm gear. An associated switch initiates the driving of the electronic assembly and motor. Provided last is a control member. The member is adapted to be pressed to drive the motor rotating the gear assembly and channel member and deadbolt.

7 Claims, 5 Drawing Sheets

KEYLESS LOCKING SYSTEM

BACKGROUND OF THE INVENTION

1. Field of the Invention

The present invention relates to a keyless locking system and more particularly pertains to confidently locking and unlocking a dead bolt of a door from a remote location.

2. Description of the Prior Art

The use of locking systems of known designs and configurations is known in the prior art. More specifically, locking systems of known designs and configurations previously devised and utilized for the purpose of locking and unlocking doors through known methods and apparatuses are known to consist basically of familiar, expected, and obvious structural configurations, notwithstanding the myriad of designs encompassed by the crowded prior art which has been developed for the fulfillment of countless objectives and requirements.

U.S. Pat. No. 3,829,138 to Morita discloses a remotely controlled latch system for fire doors and the like. U.S. Pat. No. 4,593,543 to Stefanek discloses a security lock. U.S. Pat. No. 5,896,769 to Elpern et al. discloses a electrically operated actuator. U.S. Pat. No. 5,979,199 to Elpern et al. discloses an electrically operated actuator. Lastly, U.S. Pat. No. 5,987,818 to Dabideen discloses a remotely controlled door locking and opening system.

While these devices fulfill their respective, particular objectives and requirements, the aforementioned patents do not describe a keyless locking system that allows confidently locking and unlocking a dead bolt of a door from a remote location.

In this respect, the keyless locking system according to the present invention substantially departs from the conventional concepts and designs of the prior art, and in doing so provides an apparatus primarily developed for the purpose of confidently locking and unlocking a dead bolt of a door from a remote location.

Therefore, it can be appreciated that there exists a continuing need for a new and improved keyless locking system which can be used for confidently locking and unlocking a dead bolt of a door from a remote location. In this regard, the present invention substantially fulfills this need.

SUMMARY OF THE INVENTION

In view of the foregoing disadvantages inherent in the known types of locking systems of known designs and configurations now present in the prior art, the present invention provides an improved keyless locking system. As such, the general purpose of the present invention, which will be described subsequently in greater detail, is to provide a new and improved keyless locking system and method which has all the advantages of the prior art and none of the disadvantages.

To attain this, the present invention essentially comprises a housing. The housing is in a generally rectilinear configuration. The housing also has a planar plate constituting a front wall with an upper edge, a lower edge, and parallel side edges there between. Peripheral edge walls extend inwardly from the upper edge, lower edge and side edges. In this manner an open housing is formed there between. A rotatable assembly is provided next. The assembly is rotatably secured to the front wall adjacent to the lower edge. The assembly includes a rotator. The rotator extends inwardly from the front wall. The rotator is adapted to be manually turned or turned from a remote location. A cylindrical shaft extends through the front wall of the housing. A spring loaded retention member and a channel member are provided. A trapezoidal end plate is also provided. The channel member has a parallel plate. The parallel plate has a first end, a second end and a pair of inwardly extending sidewalls to encompass and contact the sides of the deadbolt to cause the turning thereof. The first end has a retention bar between the sidewalls. The spring loaded retention member comprises a generally rectilinear body. The body has a pair of sides parallel the side walls of the channel member. The spring loaded retention member further comprises a central aperture. The central aperture is adapted to allow passage of the shaft. A spring is provided parallel to the channel member. The body of the spring loaded retention member also includes a finger like projection. The trapezoidal end plate is coupled an end of the shaft and positioned parallel to the body of the spring loaded retention member. The trapezoidal end plate is adapted to be rotated upon the rotation of the shaft to radially withdraw the projection. Next provided is a gearing assembly. The gearing assembly includes a large gear. The large gear has peripheral teeth. The peripheral teeth are coaxially coupled independent to the channel member and the shaft. The large gear also has a plurality of space pins pointing inwardly around the outside edge. The gearing assembly also includes three smaller gear of various diameters. These gears have peripheral teeth. The teeth include a first gear, second gear and third gear. The first gear is in mating contact with the teeth of the larger gear for mutual rotation there between. The second and third gears share an axis. The second gear is in mating contact with the first gear. The third gear is in mating contact with a worm gear. The worm gear has spiral teeth whereby rotation of the worm gear about an axis perpendicular to the axis of the large gear and small gears will rotate the smaller gears. Then the larger gear causes the pins to contact the projection of the spring loaded retention member causing the rotation of the channel member and deadbolt to lock and unlock the door. In the manual operation of the deadbolt, the shaft rotates independent of the gears. Projection of the spring loaded retention member is overcome by the action of the trapezoidal plate. A motor is provided next. The motor is within the housing. The motor has an associated battery to drive the worm gear. An electronic assembly is also provided. The electronic assembly effects the driving of the motor and the worm gear. The electronic assembly has an associated switch under the control of an operator. The switch initiates the driving of the electronic assembly, motor, a light and a speaker. Further provided is a control member. The control member is adapted to be held by the hand of the user. The control member includes a button. The button is adapted to be pressed to drive the motor a predetermined number of revolutions to rotate the worm gear, smaller gears, large gear, channel member and deadbolt for either locking or unlocking the door. Last provided is an adhesive. The adhesive is secured to the housing interiorly of the edge walls. In this manner the housing is secured onto a door with the channel member over the deadbolt of the door.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved keyless locking system which has all of the advantages of the prior art locking systems of known designs and configurations and none of the disadvantages.

It is another object of the present invention to provide a new and improved keyless locking system which may be easily and efficiently manufactured and marketed.

It is further an object of the present invention to provide a new and improved keyless locking system which is of durable and reliable constructions.

An even further object of the present invention is to provide a new and improved keyless locking system which is susceptible of a low cost of manufacture with regard to both materials and labor, and which accordingly is then susceptible of low prices of sale to the consuming public, thereby making such keyless locking system economically available to the buying public.

Even still another object of the present invention is to provide a keyless locking system for confidently locking and unlocking a dead bolt of a door from a remote location.

Lastly, it is an object of the present invention to provide a new and improved keyless locking system comprises a housing with a planar plate constituting a front wall and peripheral walls extending inwardly to form an open housing. A rotatable assembly is rotatably secured within the housing. The rotatable assembly includes a rotator with a cylindrical shaft, a spring loaded retention member, a channel member and a trapezoidal end plate. The channel member has a parallel plate with a pair of sidewalls to encompass and contact the sides of a deadbolt. The first end has a retention bar between the sidewalls. A gearing assembly and an associated motor are provided. An electronic assembly is provided to effect the driving of the motor and worm gear. An associated switch initiates the driving of the electronic assembly and motor. Provided last is a control member. The member is adapted to be pressed to drive the motor rotating the gear assembly and channel member and deadbolt.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
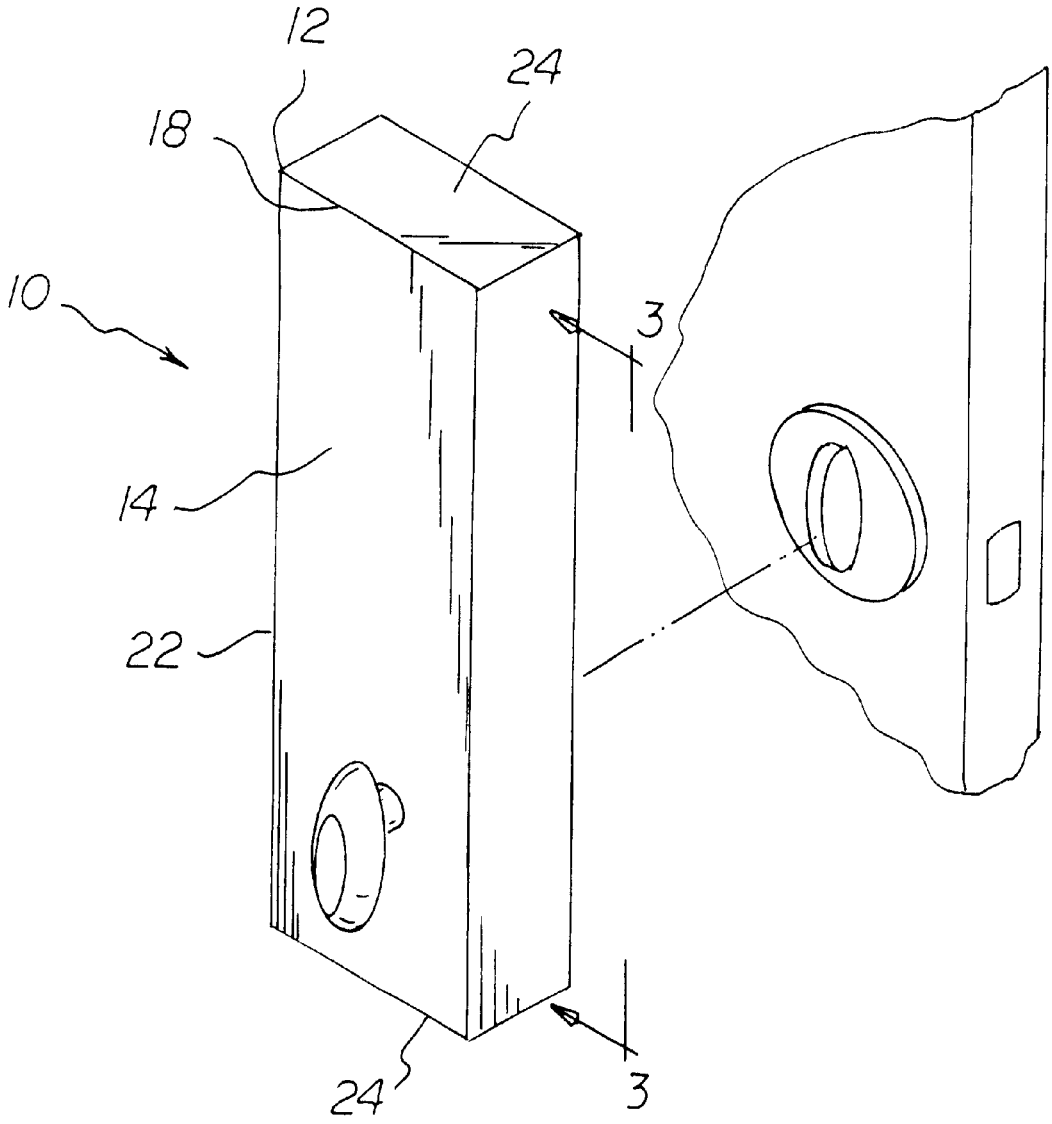
FIG. 1 is a perspective illustration of the keyless locking system constructed in accordance with the principles of the present invention.
Figure 2:
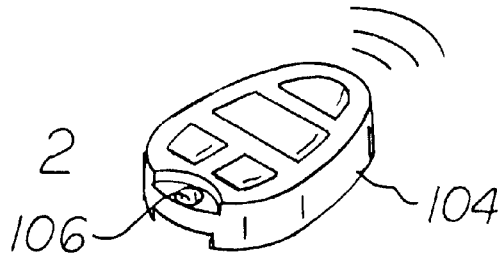
FIG. 2 is a perspective illustration of the control mechanism for the system of FIG. 1.
Figure 3:
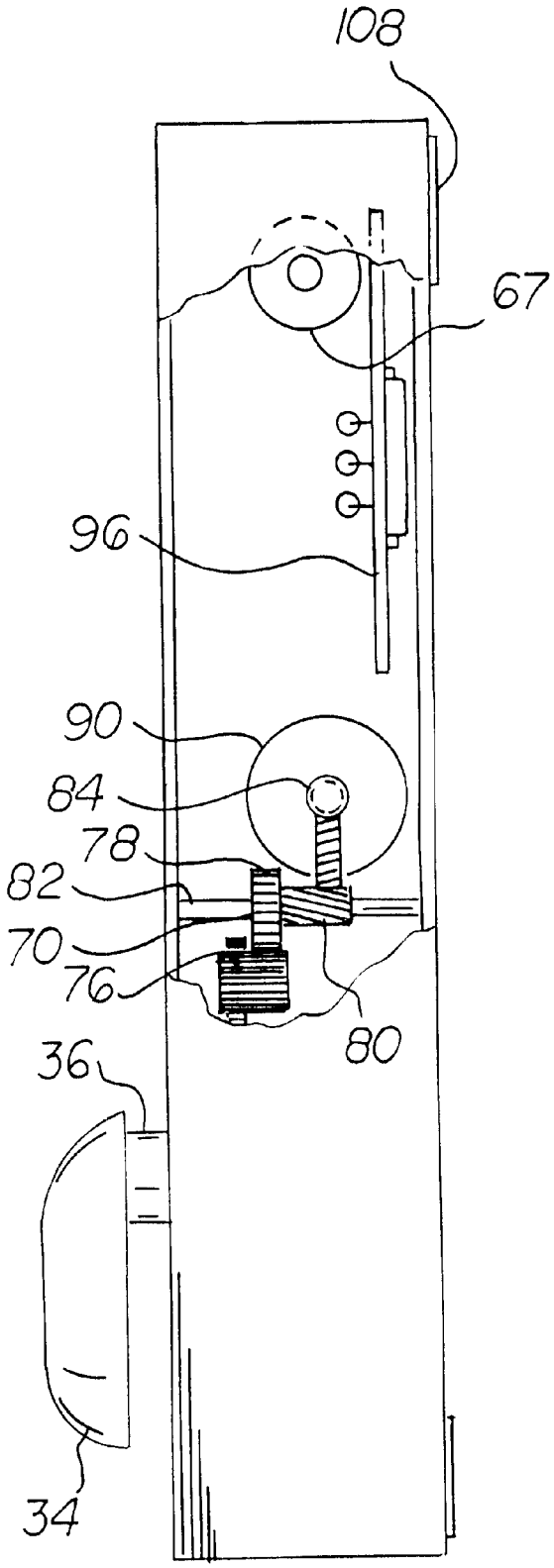
FIG. 3 is a side elevational view of the housing with parts removed to show internal construction.
Figure 4:
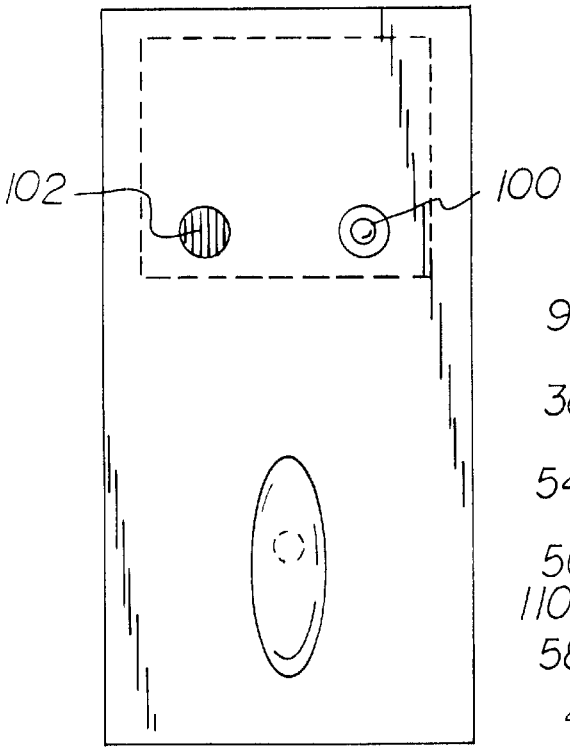
FIG. 4 is a front elevational view of the housing shown in FIG. 1 and 3.
Figure 5:
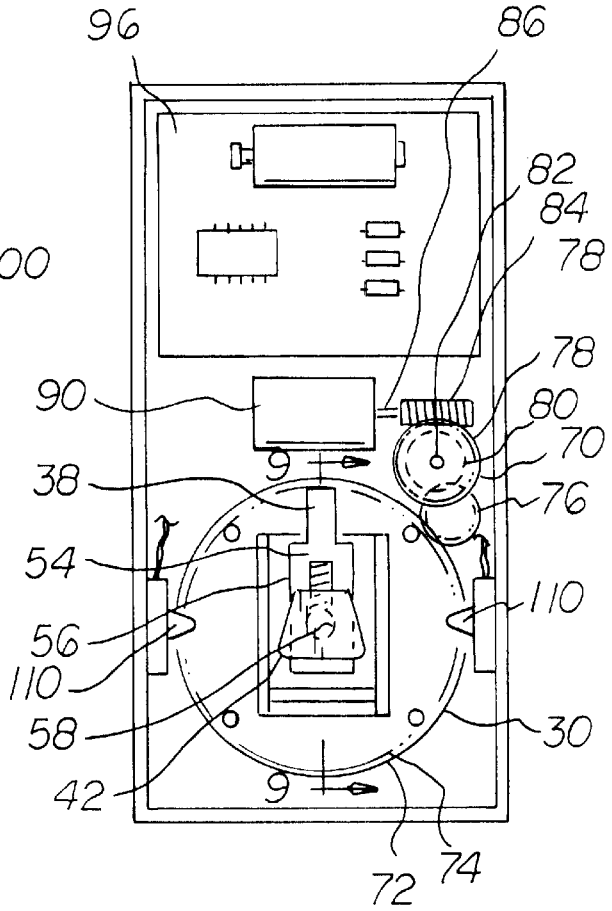
FIG. 5 is a rear elevational view of the housing shown in FIG. 4.
Figure 6:
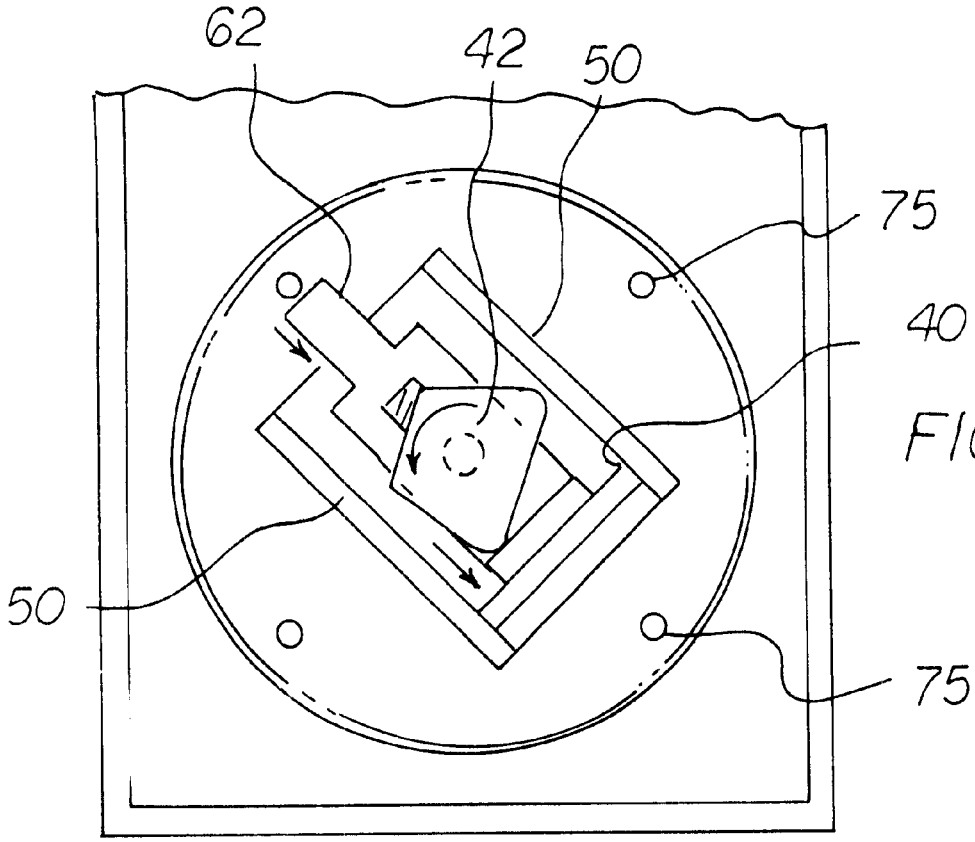
FIG. 6 is an enlarged elevational view of the rotatable assembly shown in FIG. 5 but with components partially rotated.
Figure 7:
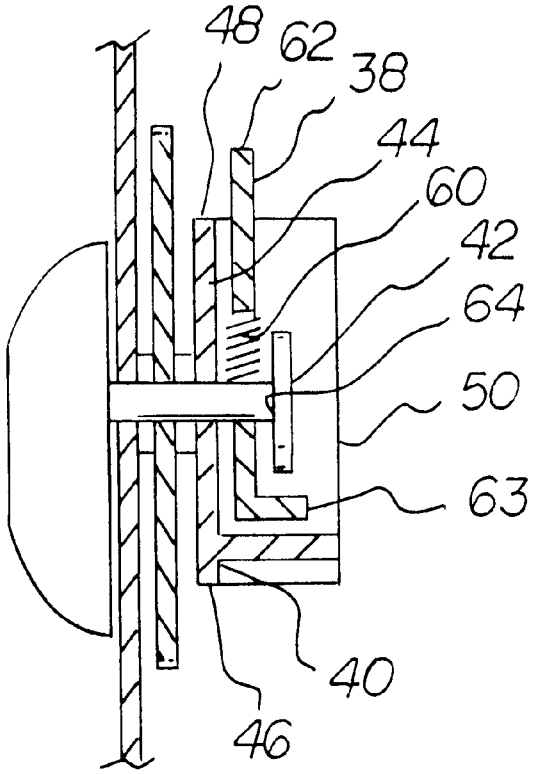
FIG. 7 is a cross-sectional view of the rotatable assembly taken along line 7—7 of FIG. 5.
Figure 8:
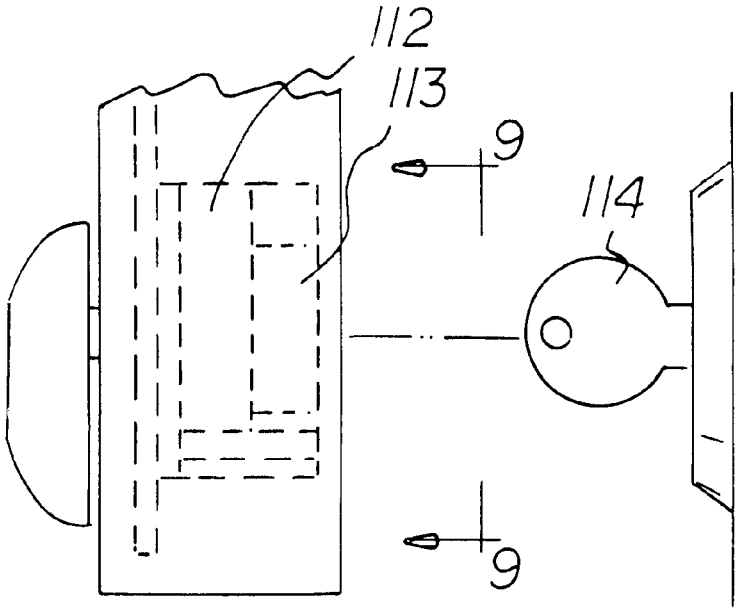
FIGS. 8 and 9 is a side elevational view and a front elevational view of an inset for allowing the present invention to be used with a key in a lock without a dead bolt handle.
Figure 9:
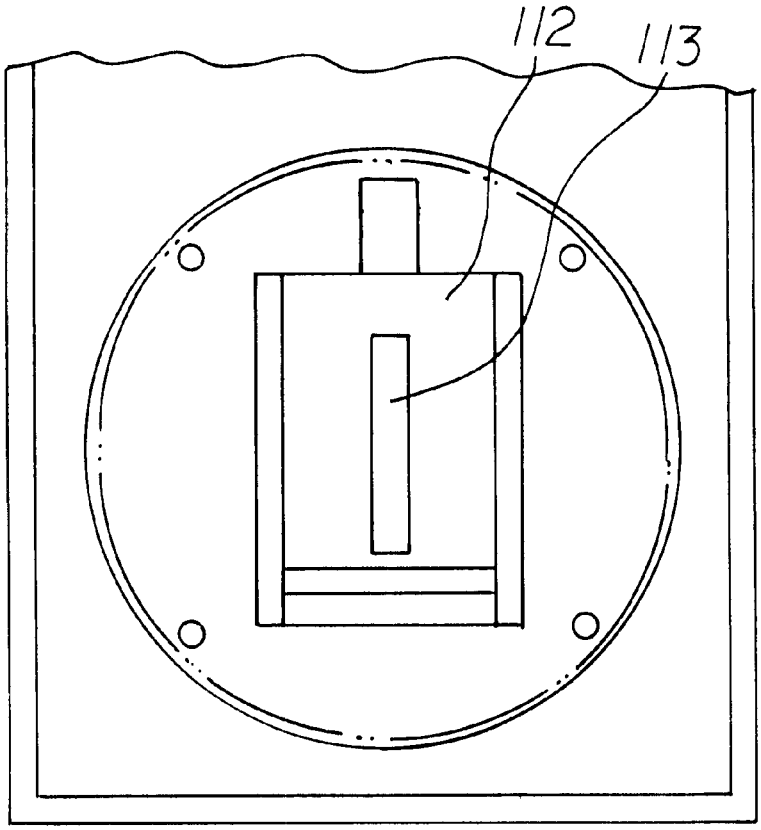

With reference now to the drawings, and in particular to FIG. 1 thereof, the preferred embodiment of the new and improved keyless locking system embodying the principles and concepts of the present invention and generally designated by the reference numeral 10 will be described.

The present invention, the keyless locking system 10 is comprised of a plurality of components. Such components in their broadest context include a housing, a rotatable assembly, a gearing assembly, a motor, an electronic assembly and a control member. Such components are individually configured and correlated with respect to each other so as to attain the desired objective.

First provided is a housing 12. The housing is in a generally rectilinear configuration. The housing also has a planar plate 14 constituting a front wall 16 with an upper edge 18, a lower edge 20, and parallel side edges 22 there between. Peripheral edge walls 24 extend inwardly from the upper edge, lower edge and side edges. In this manner an open housing is formed there between.

A rotatable assembly 30 is provided next. The assembly is rotatably secured to the front wall 16 adjacent to the lower edge. The assembly includes a rotator 34. The rotator extends inwardly from the front wall. The rotator is adapted to be manually turned or turned from a remote location. A cylindrical shaft 36 extends through the front wall of the housing and is secured to the rotator for rotation therewith. A spring loaded retention member 38 and a channel member 40 are provided and mounted on the shaft for rotation with respect thereto. A trapezoidal end plate 42 is also provided and is secured to the shaft for a rotation therewith. The channel member has a parallel plate 44. The parallel plate has a first end 46, a second end 48 and a pair of inwardly extending sidewalls 50 to encompass and contact the sides of the deadbolt to cause the turning thereof. The first end has a retention bar 52 between the sidewalls. The spring loaded retention member comprises a generally rectilinear body 54. The body has a pair of sides 56 parallel the side walls of the channel member. The spring loaded retention member further comprises a central aperture 58. The central aperture is adapted to allow passage of the shaft. A spring 60 is provided parallel to the channel member. The body of the spring loaded retention member also includes a finger like projection 62 at one end and a ledge 63 at the other end. The trapezoidal end plate is coupled to an end 64 of the shaft and positioned parallel to the body of the spring loaded retention member. The trapezoidal end plate is adapted to be rotated upon the rotation of the shaft to rotate the channel member but to radially withdraw the projection upon meeting an obstruction.

Next provided is a gearing assembly 70. The gearing assembly includes a large gear 72. The large gear has peripheral teeth 74. The peripheral teeth are coaxially coupled independent to the channel member and the shaft. The large gear also has a plurality of space pins 75 pointing inwardly around the outside edge. The gearing assembly also includes three smaller gear of various diameters. These gears have peripheral teeth. The teeth include a first gear 76, second gear 78 and third gear 80. The first gear is in mating contact with the teeth of the larger gear for mutual rotation there between. The second and third gears share an axis 82. The second gear is in mating contact with the first gear. The third gear is in mating contact with a worm gear 84. The worm gear has spiral teeth whereby rotation of the worm gear about an axis 86 perpendicular to the axis of the large gear and small gears will rotate the smaller gears. Then the larger gear causes the pins to contact the projection of the spring loaded retention member causing the rotation of the channel member and deadbolt to lock and unlock the door. In the manual operation of the deadbolt, the shaft rotates independent of the gears. Projection of the spring loaded retention member is overcome by the action of the trapezoidal plate bearing upon the ledge of the retention members to withdraw the finger like projection.

A motor 90 is provided next. The motor is within the housing. The motor has an associated battery to drive the worm gear.

An electronic assembly 96 is also provided. The electronic assembly effects the driving of the motor and the worm gear. The electronic assembly has an associated switch 98 under the control of an operator. The switch initiates the driving of the electronic assembly, motor, a light 100 and a speaker 102.

Further provided is a control member 104. The control member is adapted to be held by the hand of the user. The control member includes a button 106. The button is adapted to be pressed to drive the motor a predetermined number of revolutions to rotate the worm gear, smaller gears, large gear, channel member and deadbolt for either locking or unlocking the door.

The dead bolt can thus be turned by a user turning the rotator manually which rotates the trapezoid which, in turn, due to the trapezoid contacting the ledge of the retention member, rotates the channel member. Alternatively, the motor and gears may rotate the large gear so that the finger like projection is contacted by the pins of the large gear to rotate the retention member and channel member. Limit switches 110 are located adjacent to the large gear and are adapted to be sequentially contacted by the rotation of the finger 38 in opposite directions for reversing the direction of the motor for the sequential opening and closing of the lock.

The last feature of the invention is a removable insert 112. The insert has a key-receiving slot 113. The insert is positionable within the U-shaped channel for positioning over a key 114 within the lock without a dead bolt handle.

Last provided is an adhesive 108. The adhesive is secured to the housing interiorly of the edge walls. In this manner the housing is secured onto a door with the channel member over the deadbolt of the door.

The primary embodiment, as described above, includes a fixed code in the receiver matched to the code of the sender. It should be appreciated, however, that a rolling code technology could be utilized wherein the sender and receiver change their code for maximum security in a manner as set forth in U.S. Pat. No. 6,243,000 the subject matter of which is incorporated herein by reference.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A keyless locking system for conveniently locking and unlocking a deadbolt of a door from a remote location without modifying the existing deadbolt comprising, in combination:

a housing in a generally rectilinear configuration having a planar plate constituting a front wall with an upper edge, a lower edge, and parallel side edges there between and with peripheral edge walls extending inwardly from the upper edge, lower edge and side edges to form an open housing there between;

a rotatable assembly rotatably secured to the front wall adjacent to the lower edge, the rotatable assembly including a rotator extending inwardly from the front wall adapted to be manually turned or turned from a remote location and with a cylindrical shaft extending through the front wall of the housing, a spring loaded retention member and a channel member and finally terminating in a trapezoidal end plate, the channel member having a parallel plate with a first end, a second end and a pair of inwardly extending sidewalls to encompass and contact the sides of the deadbolt to cause the turning thereof, the first end having a retention bar between the sidewalls, the spring loaded retention member comprising a generally rectilinear body with a pair of sides parallel the side walls of the channel member, the spring loaded retention member further comprising a central aperture adapted to allow passage of the shaft and a spring parallel to the channel member, the body of the spring loaded retention member also including a finger like projection, the trapezoidal end plate being coupled an end of the shaft and positioned parallel to the body of the spring loaded retention member, the trapezoidal end plate adapted to be rotated upon the rotation of the shaft to radially withdraw the projection;

a gearing assembly including a large gear having peripheral teeth coaxially coupled independent to the channel member and the shaft, the large gear also has a plurality of space pins pointing inwardly around the outside edge and the gearing assembly also includes three smaller gear of various diameters having peripheral teeth including a first gear, second gear and third gear, with the first gear in mating contact with the teeth of the larger gear for mutual rotation there between and the second and third gear sharing an axis with the second gear in mating contact with the first gear and the third gear in mating contact with a worm gear having spiral teeth whereby rotation of the worm gear about an axis perpendicular to the axis of the large gear and small gears will rotate the smaller gears and then the larger gear to cause the pins to contact the projection of the spring loaded retention member causing the rotation of the channel member and deadbolt to lock and unlock the door, in the manual operation of the deadbolt the shaft rotates independent of the gears and projection of the spring loaded retention member is overcome by the action of the trapezoidal plate;

a motor within the housing with an associated battery to drive the worm gear;

an electronic assembly to effect the driving of the motor and worm gear with an associated switch under the control of an operator for initiating the driving of the electronic assembly, motor, a light and a speaker;

a control member adapted to be held by the hand of the user, the control member including a button adapted to be pressed to drive the motor a predetermined number of revolutions to rotate the worm gear, smaller gears, large gear, channel member and deadbolt for either locking or unlocking the door; and an adhesive secured to the housing interiorly of the edge walls to secure the housing onto a door with the channel member over the deadbolt of the door.

2. A keyless locking system comprising:

a housing having a planar plate constituting a front wall and peripheral walls extending inwardly to form an open housing there between;

a rotatable assembly rotatably secured within the housing including a rotator with a cylindrical shaft, a spring loaded retention member, a channel member and a trapezoidal end plate, the channel member having a parallel plate with a pair of sidewalls to encompass and contact the sides of a deadbolt, the first end having a retention bar between the sidewalls;

a gearing assembly;

a motor to drive the gear assembly;

an electronic assembly to effect the driving of the motor and worm gear with an associated switch for initiating the driving of the electronic assembly and motor; and a control member adapted to be pressed to drive the motor to rotate the gear assembly and channel member and deadbolt.

3. The system as set forth in claim 2 and further including an adhesive secured to the housing interiorly of the edge walls to secure the housing onto a door with the channel member over the deadbolt of the door.

4. The system as set forth in claim 2 wherein the spring loaded retention member comprises a generally rectilinear body with a pair of sides parallel to the side walls of the channel member, the spring loaded retention member further comprising a central aperture adapted to allow passage of the shaft and a spring parallel to the channel member and the body of the spring loaded retention member also including a finger like projection.

5. The system as set forth in claim 2 wherein the trapezoidal end plate is coupled to an end of the shaft and positioned parallel to the body of the spring loaded retention member, the trapezoidal end plate adapted to be rotated upon the rotation of the shaft.

6. The system as set forth in claim 2 and further including a light and a speaker to signify the action and deactivation of the system.

7. The system as set forth in claim 2 and further including a removable insert positionable within the U-shaped channel for positioning over a key within the lock without a dead bolt handle.

* * * * *